United States Patent [19]

Burke, II et al.

[11] Patent Number: 4,875,508

[45] Date of Patent: Oct. 24, 1989

[54] BEVERAGE CONTAINER SUITABLE FOR USE IN OUTER SPACE

[75] Inventors: Robert W. Burke, II, Stone Mountain; Albert J. Cahen, Jr., Roswell; William S. Credle, Jr., Stone Mountain; Ashis S. Gupta, Marietta; Richard H. Heenan, Atlanta, all of Ga.

[73] Assignee: The Coca-Cola Company, Atlanta, Ga.

[21] Appl. No.: 779,840

[22] Filed: Sep. 25, 1985

Related U.S. Application Data

[62] Division of Ser. No. 623,701, Jun. 22, 1985, abandoned.

[51] Int. Cl.[4] ..... B65B 3/00

[52] U.S. Cl. ..... 141/2; 141/1; 141/18; 141/114; 222/95; 222/386.5

[58] Field of Search ..... 222/92, 94, 95, 105, 222/386, 386.5, 389; 141/1, 114, 2–8, 18, 23–25, 37, 348–350; 215/1 C, 11 C; 220/403, 404, 411

[56] References Cited

U.S. PATENT DOCUMENTS

| | | | |
|---|---|---|---|
| 2,762,534 | 9/1956 | Kish | 222/386.5 |
| 2,816,690 | 12/1957 | Lari | 222/92 |
| 2,823,953 | 2/1958 | McGeorge | 222/389 X |
| 3,169,670 | 2/1965 | Hrebenak et al. | 222/95 |
| 3,233,779 | 2/1966 | Cornelius | 222/95 X |
| 3,323,206 | 6/1967 | Clark | 222/92 X |
| 3,456,847 | 7/1969 | Scott | 222/95 |
| 3,467,283 | 9/1969 | Kinnary | 222/95 |
| 4,066,596 | 1/1978 | Stern | 222/95 X |
| 4,077,544 | 3/1978 | Malacheski et al. | 222/95 |
| 4,121,737 | 10/1978 | Kain | 222/95 |
| 4,136,802 | 1/1979 | Mascia et al. | 222/95 |
| 4,264,019 | 4/1981 | Roberts et al. | 222/95 |
| 4,445,539 | 5/1984 | Credle | 137/614.03 |
| 4,488,663 | 12/1984 | Hooper et al. | 222/43 |

*Primary Examiner*—Ernest G. Cusick

*Attorney, Agent, or Firm*—Birch, Stewart, Kolasch & Birch

[57] ABSTRACT

A beverage container suitable for use in outer space comprising a beverage-containing chamber which expands with the introduction of fluid therein and collapses to a negligible volume when beverage is dispensed therefrom. In a first embodiment, the chamber is an elastic bag. In a second embodiment, the chamber is a flexible bag surrounded by a compressible gas. In a third embodiment, the chamber is an accordion-type container. In a fourth embodiment, the chamber is a tube having a rolled tail portion which is naturally biased by the elastic properties of the material from which the tube is formed, to roll up on itself to a negligible volume in the absence of beverage therein and assumes the volume of the beverage as the beverage is introduced.

6 Claims, 3 Drawing Sheets

BEVERAGE CONTAINER SUITABLE FOR USE IN OUTER SPACE

This application is a division of Ser. No. 623,701 filed June 22, 1985, now abandoned.

BACKGROUND OF THE INVENTION

The present invention relates to a beverage container for serving beverages in outer space in the controlled environment of a space station or the like. More specifically, the present invention relates to such a container which will function in that environment notwithstanding the zero gravity conditions of outer space.

The containers of the present invention may be utilized in the beverage dispenser disclosed in applicants' copending application entitled "Post-Mix Beverage Dispenser System Suitable For Use In Outer Space", filed on even date herewith.

The operation of a beverage container in outer space presents some unique problems which are not encountered on earth. Most significant is the absence of gravity because under zero gravity conditions there is no natural separation of gaseous and liquid phases within the container. Therefore, there is no headspace formed within the container from air or carbon dioxide as there would be on earth. In addition, beverage containers in the controlled environment of a space station or the like in outer space are often subjected to temperatures in excess of 100° F. (37.8° .C) and they must be able to withstand lift-off and landing conditions of spacecraft. Furthermore, it is imperative in the environment of a space staion to control the pressure of carbonated beverages therein so that they do not exceed two to three p.s.i. in order to assure comfortable beverage consumption by astronauts. Accordingly, a need in the art exists for a beverage container which operates satisfactorily under the above unique conditions and any other conditions which may be encountered in the controlled environment of a space station.

SUMMARY OF THE INVENTION

It is a primary object of the present invention to provide a beverage container which can be filled or drunk from in the zero gravity conditions of outer space.

It is a further object of the present invention to provide a beverage container which may be filled with liquid without creating a gaseous phase therein.

It is still a further object of the present invention to provide a quick-disconnect coupling device with flow rate control valves therein utilized for filling or withdrawing beverage from the container.

It is another object of the present invention to provide a light-weight beverage container that will withstand pressure reductions to zero pounds (gauge).

It is yet another object of the present invention to provide a beverage container which will withstand lift-off and landing conditions encountered in a spacecraft.

It it still another object of the present invention to provide a beverage container which will store carbonated or still beverages on earth or outer space for extended periods of time without deterioration.

It is a further object of the present invention to provide a carbonated beverage container from materials having the proper barrier properties which preclude the loss of carbon dioxide gas.

The objects of the present invention are fulfilled according to a first embodiment by a beverage container including a rigid, outer shell having an opening for accommodating the flow of beverage to and from the container and an elastic bag disposed within the rigid outer shell, the elastic bag having an opening connected to the opening of the rigid outer shell, said elastic bag having a normal, unexpanded volume much smaller than the volume of the rigid outer shell and an expandable volume which follows the volume of beverage therein up to a maximum volume equal to the volume of the rigid, outer shell. The elastic bag expands toward the maximum volume when beverage is introduced thereinto and contracts toward the normal volume when the beverage is dispensed therefrom. Accordingly, a gaseous phase cannot develop within the beverage container.

In a second embodiment, a flexible rather than an elastic bag is provided in the rigid, outer shell, and the space between the flexible bag and the rigid, outer shell is fitted with a compressible gas. Accordingly, when the flexible bag expands toward the walls of the rigid, outer shell in response to the introduction of beverage therein, the surrounding gas compresses. As beverage is dispensed from the bag, the surrounding gas expands to assist in the withdrawal of beverage from the flexible bag.

In an additional embodiment, the elastic and flexible bag are replaced by an accordion-type container having a conical shape, sidewalls thereof being flexible and having accordion-like folds, end walls thereof being substantially rigid, said accordion-type container having an opening for accommodating the flow of beverage therethrough. A coil spring is provided for exerting a force on the substantially rigid end walls to push the same towards each other to a totally collapsed condition. because of the conical shape of the container, a substantially totally-collapsed, planar configuration can be achieved.

In an additional embodiment, the beverage is contained within an elastic tube having an opening at one end for accommodating the flow of beverage therethrough and a rolled tail portion at the opposite end thereof, said tail portion tending to roll up to a position juxtaposed to the opening under the natural elastic bias of the material from which it is formed, when the tube is empty; and unrolling to a point controlled by the volume of the beverage therein when the beverage is introduced.

Accordingly, each of the embodiments of the beverage container of the present invention provide for an expandable and collapsible chamber which assumes a volume equal to the liquid therein, and precludes the formation of a gaseous phase therein either during a filling or dispensing operation.

BRIEF DESCRIPTION OF THE DRAWINGS

The objects of the present invention and the attendant advantages thereof will become more readily apparent by reference to the following drawings, wherein like numerals refer to like parts and wherein.

DETAILED DESCRIPTION OF PREFERRED EMBODIMENTS

Figures 1, 2, 3, 4:
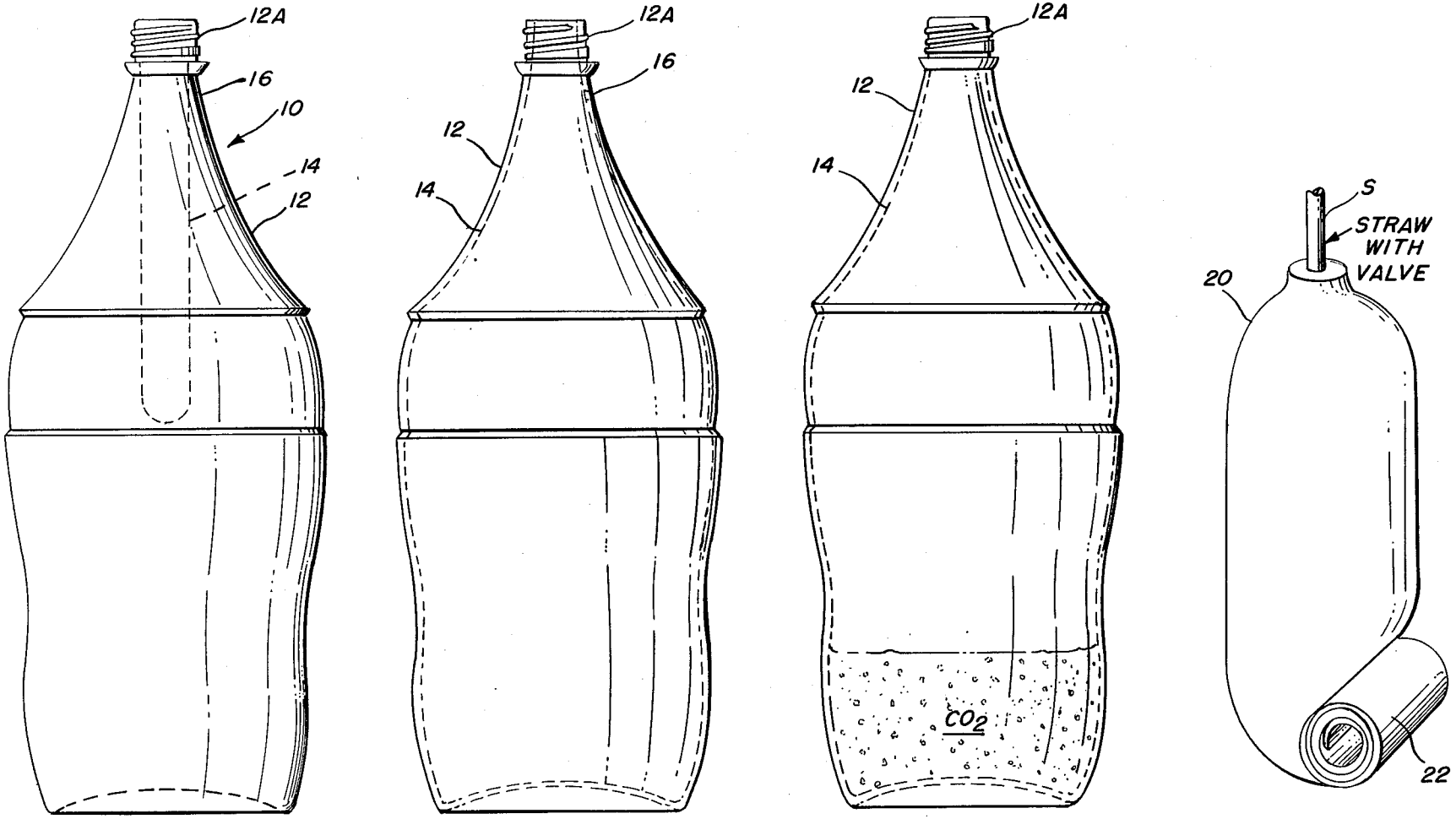
FIGS. 1 and 2 are side elevational views of a first embodiment of a beverage container of the present invention.
FIGS. 3 is a side elevational view of a second embodiment of a beverage container of the present invention.
FIG. 4 is a perspective view of a third embodiment of a beverage container of the present invention.

Referring to FIGS. 1 and 2, there is illustrated a beverage container 10 including a rigid, outer bottle 12 and an elastic inner bag 14. The rigid outer bottle 12 is provided with a small vent hole 16 to permit the expansion of bag 14 as liquid is introduced into the same. FIG. 1 shows the bag 14 in an empty condition and FIG. 2 shows bag 14 in a full, fully-expanded condition. It can be seen from these Figures, as bag 14 is filled with liquid, it fully conforms to the inside walls of rigid, outer bottle 12; and as liquid is dispensed from the bottle 12, the elastic bag fully collpases to the condition illustrated in FIG. 1. The use of this elastic bag 14 precludes the formation of any headspace from air or CO2 during the filling operation of the container and its elastic properties also provide a dispensing force for expelling liquid from the bag when the beverage is being consumed by an astronaut or other user.

Figure 6:
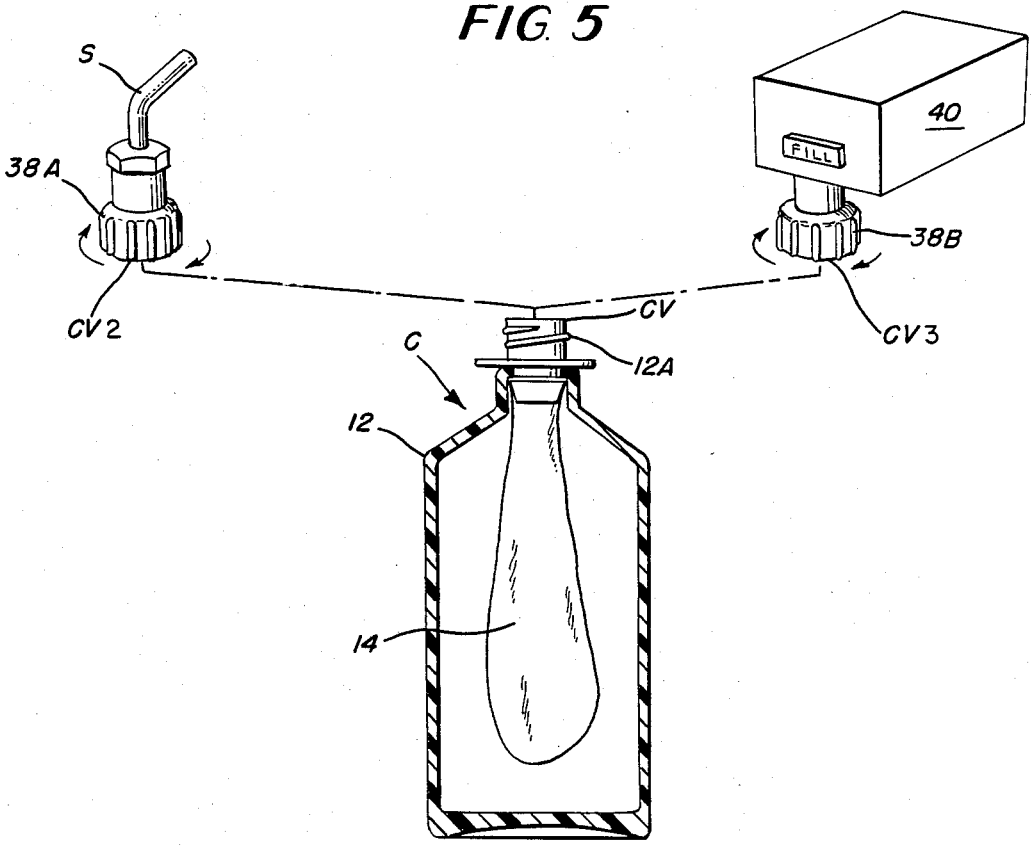
FIG. 6 is a diagrammatic view of a system for filling or withdrawing liquid from the containers of the present invention.
Figure 7:
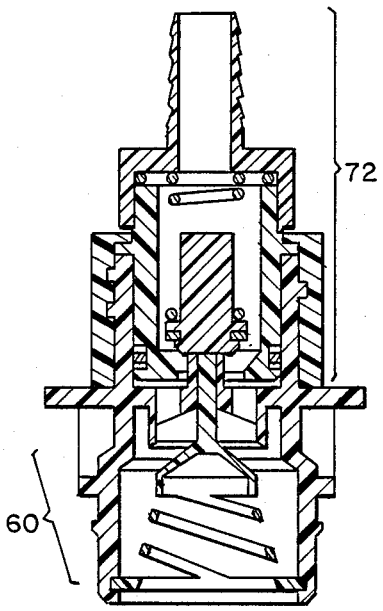
FIG. 7 is a cross-sectional view of a quickdisconnect coupling suitable for use in the system of FIG. 6.

A suitable, normally-closed valve CV1 is provided within the opening of the rigid bottle 12 in the neck portion 12A thereof. This valve is, of course, opened during either the filling of the bag 14 or dispensing of fluid from the same by a mating coupling provided in the filling machine head or a drinking straw of the type illustrated in FIG. 6. In a preferred embodiment, the neck portion 12A of the bottle 12 may be provided with a quick-disconnect coupling and valve member CV1 thereof of the type illustrated in FIG. 10 as 60 in U.S. Pat. No. 4,445,539 to Credle, issued May 1, 1984, and assigned to the same assignee as the present invention. This patent is incorporated herein by reference. In addition, the drinking straw of FIG. 6 is provided with a cooperating, normally closed, and spring-biased valve structure CV2 in the cap portion 38A of the type bearing the numeral 72 in FIG. 10 of the aforementioned Credle patent and FIG. 7 herein. Accordingly, when the cap 38A is screwed onto the neck portion 12A of bottle 12, the two opposed valves 72 and 60 of the quick-disconnect coupling will open to permit the dispensing of liquid from within bag 14.

Also illustrated in FIG. 6 is a filling head 40 of a dispensing valve including a cap 38B. Cap 38B also contains a valve CV3 such as 72 illustrated in FIG. 10 of the aforementioned Credle patent and FIG. 7 herein.

A second embodiment of the beverage container of the present invention is illustrated in Figure 3. In the embodiment of FIG. 3, bag 14 is flexible, but non-elastic and the space within the rigid bottle 12 around bag 14 is filled with a gas such as CO2. It can be seen that as the bag 14 is filled with liquid to the point as illustrated in FIG. 3, the CO2 gas surrounding the bag will become compressed and will exercise a constant force on the bag 14 during the filling operation to preclude the formation of any headspace therein. On the other hand, when the valve within the neck 12A of container 12 is opened for the purpose of drinking or dispensing the beverage within sack 14, the compressed CO2 gas within container 12 will expand and help drive liquid out of the bag 14, dispensing the same.

Still another embodiment of the beverage container of the present invention is illustrated in FIG. 4. The container of this embodiment comprises a resilient tube 20 having a rolled tail portion 22 which tends to roll to a fully collapsed or compressed condition adjacent the top of the tube. That is, the tube 20 has a memory which tends to force liquid out of the interior thereof when a valve in the end of the tube or an associated straw S is opened to permit the discharge of liquid. The valve in straw S may be of any suitable type, such as the aforementioned valve 60 in the Credle (539) patent or any other type of spring-biased valve which may be actuated to an open condition, for exàmple, by pushing on the straw S in a direction toward the mouth of the tube 20.

Figure 5:
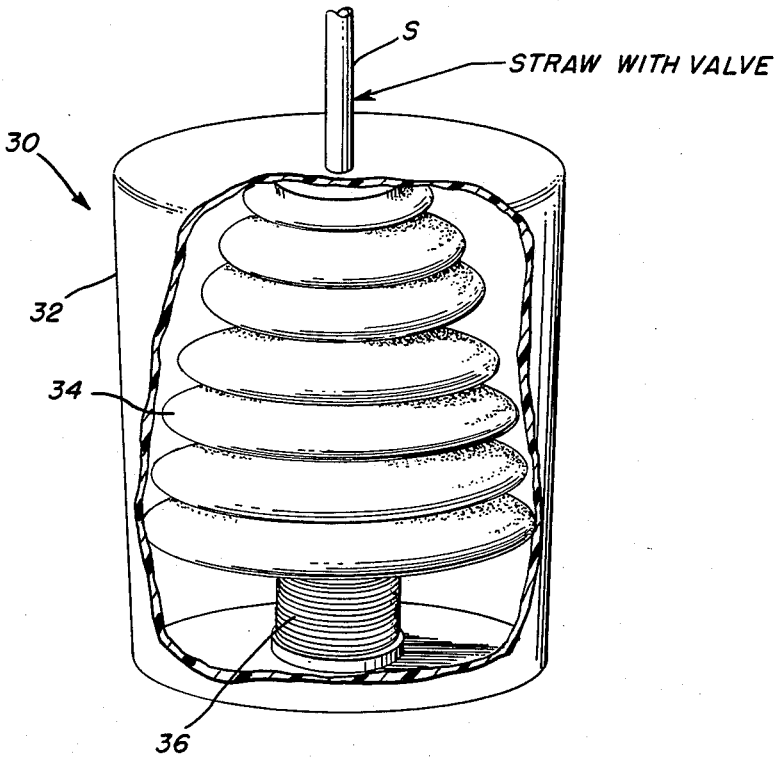
FIG. 5 is a perspective view of a fourth embodiment of a beverage container of the present invention.

An additional embodiment of the present invention is illustrated in FIG. 5. In this embodiment, the beverage container is generally indicated 30 and includes an outer, rigid, cylindrical shell 32 and an inner, conically-shaped, accordion-type container 34. This accordion-type container in the absence of liquid therein is biased into a fully flatened, and closed position under the force of a coil spring 36. However, when filled with liquid, it occupies the position illustrated in FIG. 5. Because of the spring action of coil spring 36 on the accordion-shaped, conical container 34, no headspace develops within container 34 during the filling thereof with liquid. In addition, when it is desired to dispense liquid from the container, the coil spring 36, of course, assists in pushing the liquid out of the container through the straw S. As in the other embodiments, the straw S may have a normally-closed, spring-loaded valve which may be opened by depressing the straw towards the opening of the beverage container 30. The conical shape of the accordion-type container 34 permits the container to fully collapse in concentric rings within itself without the creation of any dead space in which liquid may remain. In contrast, a cylindrical shape for accordion-type container 34 might have a dead space in the center thereof when collapsed in which liquid would accumulate without being dispensed, since the cylindrical configuration cannot totally collapse into a substantially flat configuration.

The rigid, outer bottle 12 of FIGS. 1 and 2 of the present invention may be fabricated from polycarbonate or the like and the elastic bag 14 may be from gum or silicon rubber.

The flexible bag 14 of the FIG. 3 embodiment may be polyethylene, PVDC or the like.

The rolling tube 20 of FIG. 4 may comprise a nylon and PVDC laminate on polyethylene, or it may be silicon rubber.

The accordion-type container 34 of FIG. 5 may be a nylon/polyethylene laminate, nylon alone or a polyester. The spring 36 may be steel. The straw S may be plastic or stainless steel.

It should be understood that the container described herein may be modified as would occur to one of ordinary skill in the art without departing from the spirit and scope of the present invention.

What is claimed is:

1. A method for filling a container with a carbonated beverage in the zero gravity conditions of outer space without the creation of a headspace and for dispensing said carbonated beverage therefrom directly into a consumer's mount, comprising the steps of:

(a) providing an expandable chamber in the container having means for normally biasing the expandable chamber to a minimal volume, said expandable chamber having an outlet opening with a normally closed valve therein;

(b) connecting the outlet opening in operative association with a beverage filling device;

(c) opening the valve to fill the expandable volume chamber from the minimal volume to a maximum volume against the force of the means for biasing;

(d) removing the beverage filling device from operative association with the outlet opening;

(e) connecting the outlet opening to a straw assembly; and (f) opening the valve to permit the dispensing of the carbonated beverage through the straw assembly into the consumer's mouth;

whereby essentially no headspace is formed in the carbonated beverage during either the filling of the container or the dispensing of the beverage therefrom.

2. The method if claim 1, wherein the container comprises:

(a) a rigid, outer shell with the outlet opening therein for accommodating the flow of beverage to and from the container; and (b) an elastic bag forming said expandable chamber disposed within said rigid outer shell, said elastic bag having an opening connected to the outlet opening of said rigid outer shell, said elastic bag having a normal unexpanded minimal volume much smaller than the volume of said rigid outer shell and an expandable volume which follows the volume of beverage therein up to a maximum volume equal to the volume of the rigid outer shell;

whereby said elastic bag expands toward the maximum volume when beverage is introduced thereinto and contracts toward said normal volume when said beverage is dispensed therefrom.

3. The method of claim 1, wherein the container comprises:

(a) a rigid outer shell with an outlet opening therein for accommodating the flow of said beverage to and from said container;

(b) a flexible bag forming said expandable chamber disposed within said rigid outer shell, said flexible bag having an opening connected to the outlet opening of said rigid outer shell, said flexible bag being collapsible to an unexpanded minimal volume much smaller than the volume of said rigid outer shell and having an expandable volume which follows the volume of beverage therein up to a maximum volume; and (c) said means for biasing includes a predetermined volume of compressible gas inside of said rigid outer shell surrounding said bag;

whereby said flexible bag expands toward said maximum volume when beverage is introduced therein to compress said gas and contracts towards said normal volume when said beverage is dispensed therefrom while said gas expands.

4. The method of claim 1, wherein said container comprises:

(a) an accordion-type, expandable chamber having a conical shape, sidewalls thereof being flexible and having accordion-like folds, end walls thereof being substantially rigid, said chamber having an opening for accommodating the flow of beverage therethrough; and (b) spring means for biasing said accordion-type container toward a substantially flat condition by forcing said rigid end walls together.

5. The method of claim 4 wherein the container further includes an outer rigid shell surrounding said accordion-type container.

6. The method of claim 1, wherein said container comprises:

an elastic tube forming said expandable chamber having an opening for accommodating the flow of beverage therethrough at one end and a rolled tail portion at the opposite end thereof, said tail position tending to roll up to a position juxtaposed to said opening under the natural elastic bias of the material from which it is formed when said tube is empty an unrolling to a point controlled by the volume of beverage therein when said beverage is introduced.

* * * * *